United States Patent [19]

Ivanov

[11] 4,130,969

[45] Dec. 26, 1978

[54] HANGING PRESTRESSED ROOF STRUCTURE

[75] Inventor: Ivan B. Ivanov, Pazardjik, Bulgaria

[73] Assignee: DSO "Montaji" — Promishleno Montajno Upravlenie, Plovdiv, Bulgaria

[21] Appl. No.: 749,334

[22] Filed: Dec. 10, 1976

[30] Foreign Application Priority Data

Dec. 11, 1975 [RO] Romania ..... 31755

[51] Int. Cl.[2] ..... E04D 1/32

[52] U.S. Cl. ..... 52/80; 52/83

[58] Field of Search ..... 52/80, 83

[56] References Cited

U.S. PATENT DOCUMENTS

| | | | |
|---|---|---|---|
| 1,825,800 | 10/1931 | Houseman | 52/80 |
| 2,592,465 | 4/1952 | Pont | 52/80 |
| 3,137,097 | 6/1964 | Zeinetz | 52/80 |
| 3,139,957 | 7/1964 | Fuller | 52/80 |
| 3,410,039 | 11/1968 | Brezina | 52/80 |

FOREIGN PATENT DOCUMENTS

| | | | |
|---|---|---|---|
| 371325 | 6/1973 | U.S.S.R. | 52/83 |
| 394514 | 1/1974 | U.S.S.R. | 52/83 |

*Primary Examiner*—Alfred C. Perham
*Attorney, Agent, or Firm*—Karl F. Ross

[57] ABSTRACT

A hanging prestressed roof structure comprising a polygonal member receiving a supporting ring inscribed therein. Cable nets span the ring and have cables lying along chords of the ring.

4 Claims, 10 Drawing Figures

HANGING PRESTRESSED ROOF STRUCTURE

FIELD OF THE INVENTION

This invention relates to a hanging cable prestressed roof structure with positive Gaussian curvature for buildings with polygonal, elliptical or circular contour in plan view.

BACKGROUND OF THE INVENTION

There are known hanging-cable roof structures which have, an outer stiff ring and an inner stiff ring at different levels, between which there are stretched two systems of cables. One cable system is formed of intersecting cables which are chords of the outer stiff ring and touch tangentially the inner ring, while the other cable system is disposed over the first and is formed by cables extending radially between both contours.

A drawback for this known structure lies in the need of an internal stiff ring, supported at a given level over the ground by means of a special structure, which leads to the necessity of equipment and materials for its erection and to the occupation of useful space inside the building.

The roof structure is then erected necessarily with a scaffold and a number of erection devices.

OBJECTION OF THE INVENTION

It is, therefore, an object of the present invention to provide a prestressed cable roof structure this structure being of considerable stiffness and featured by a low metal consumption and the possibility for fast and easy erection without the necessity for a scaffold.

SUMMARY OF THE INVENTION

The structure, in accordance with the invention, comprises cable nets with openings decreasing in vertical direction, disposed one over the other and connected in between by vertical supports, the upper end of the peak support being connected to the supporting ring by means of ropes which are radially disposed with respect to the ring. All cables are rigidly connected in-between at their points of crossing.

The gist of the method lies in that the structure is set up on ground level, it is prestressed, and then is lifted to the desired level by means of hoisting mechanisms.

The advantage of the disclosed structure are: considerable stiffness and minimum deformation due to symmetrical outside loading; low metal consumption; simple and easily realizable connections and anchoring devices; and the possibility of covering buildings of large spans without the loss of useful space.

The method for erecting the structure according to the invention avoids the need for a scaffold and the number of erection devices is reduced to minimum.

BRIEF DESCRIPTION OF THE DRAWING

For a better understanding of the invention, its advantages and specific objects attained by its use, reference should be made to the accompanying drawing in which there is illustrated and described a preferred embodiment of the invention. In the drawing.

SPECIFIC DESCRIPTION

Figure 1:
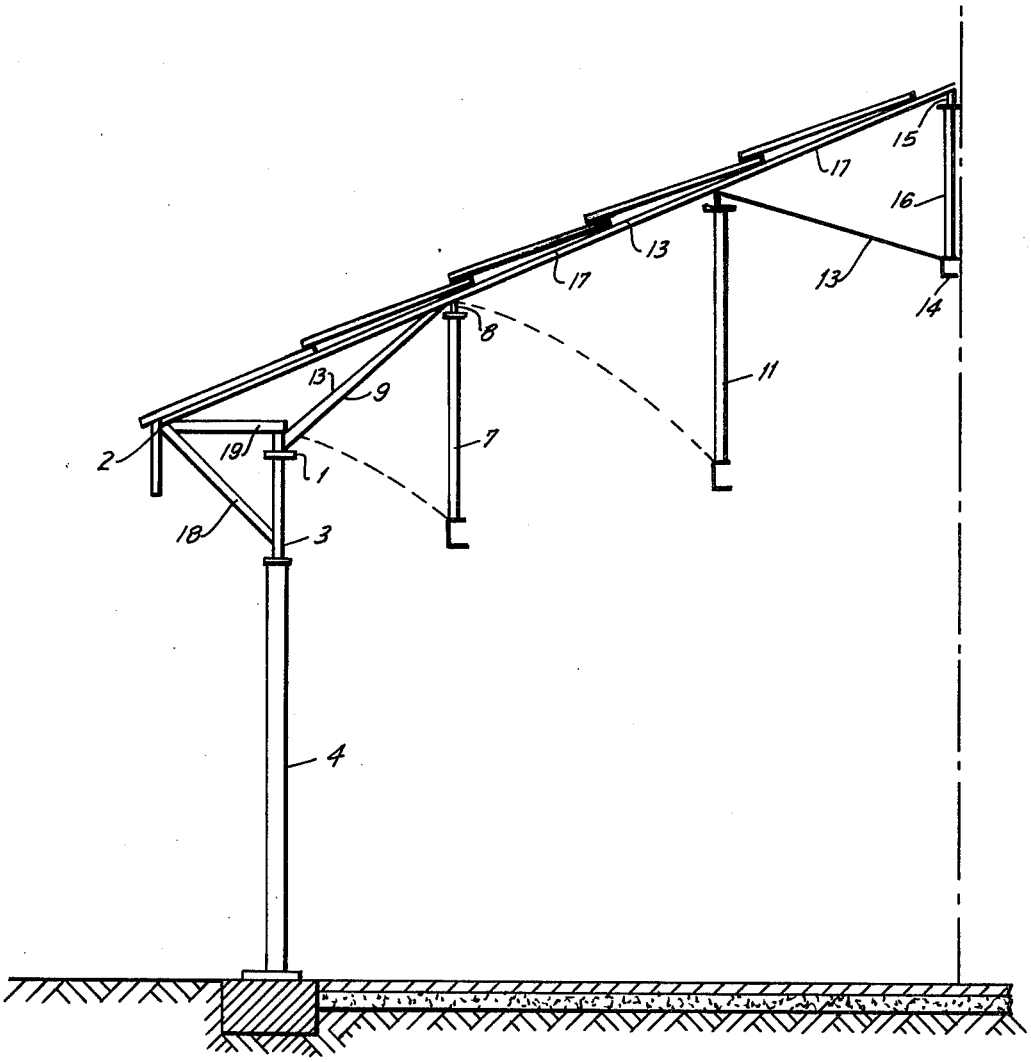
FIG. 1 is a cross-sectional view of the structure.
Figure 2:
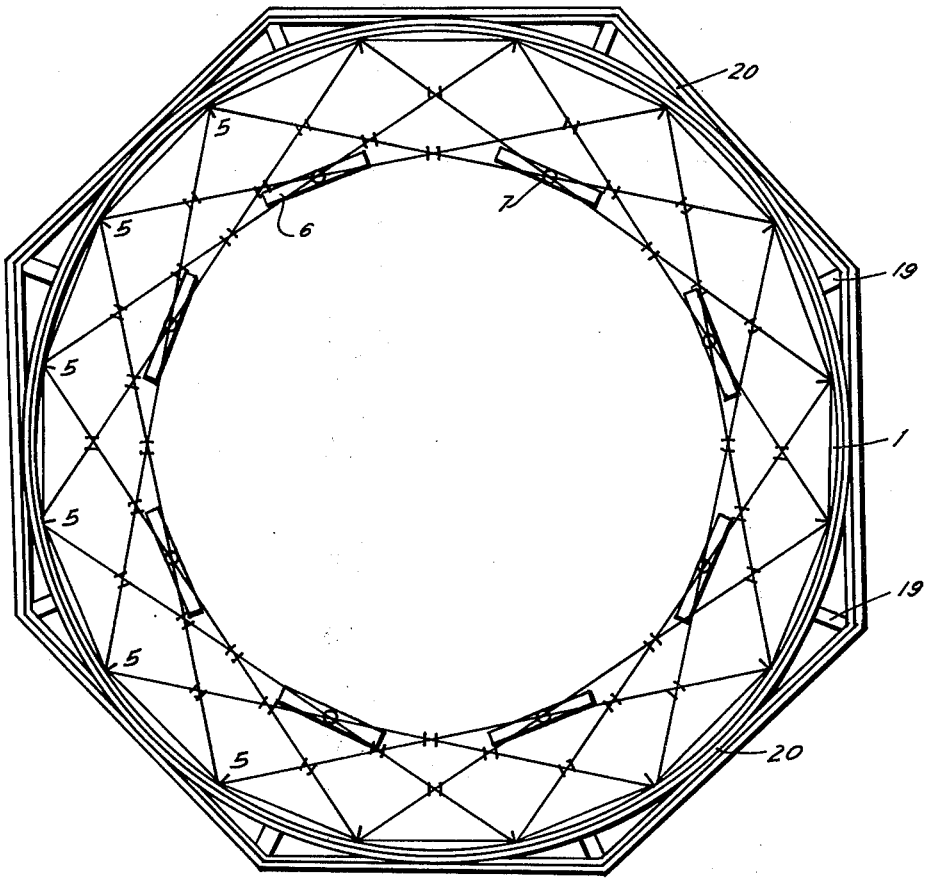
FIG. 2 is a top view of the structure with the stiff ring, a first cable net and the suspended first eight beams connecting the centers of each two adjacent chords.
Figure 3:
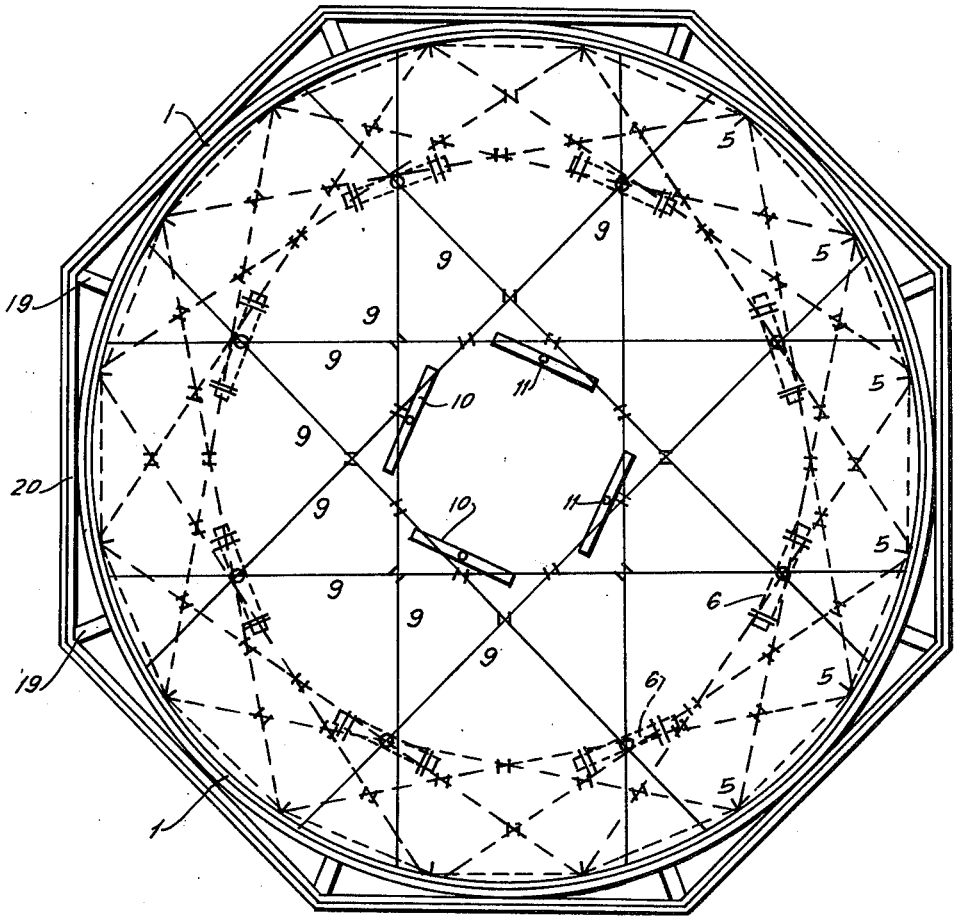
FIG. 3 is a top view of the structure with the stiff ring, and a second cable net with the suspended beams connecting the centers of the adjacent cables.
Figure 4:
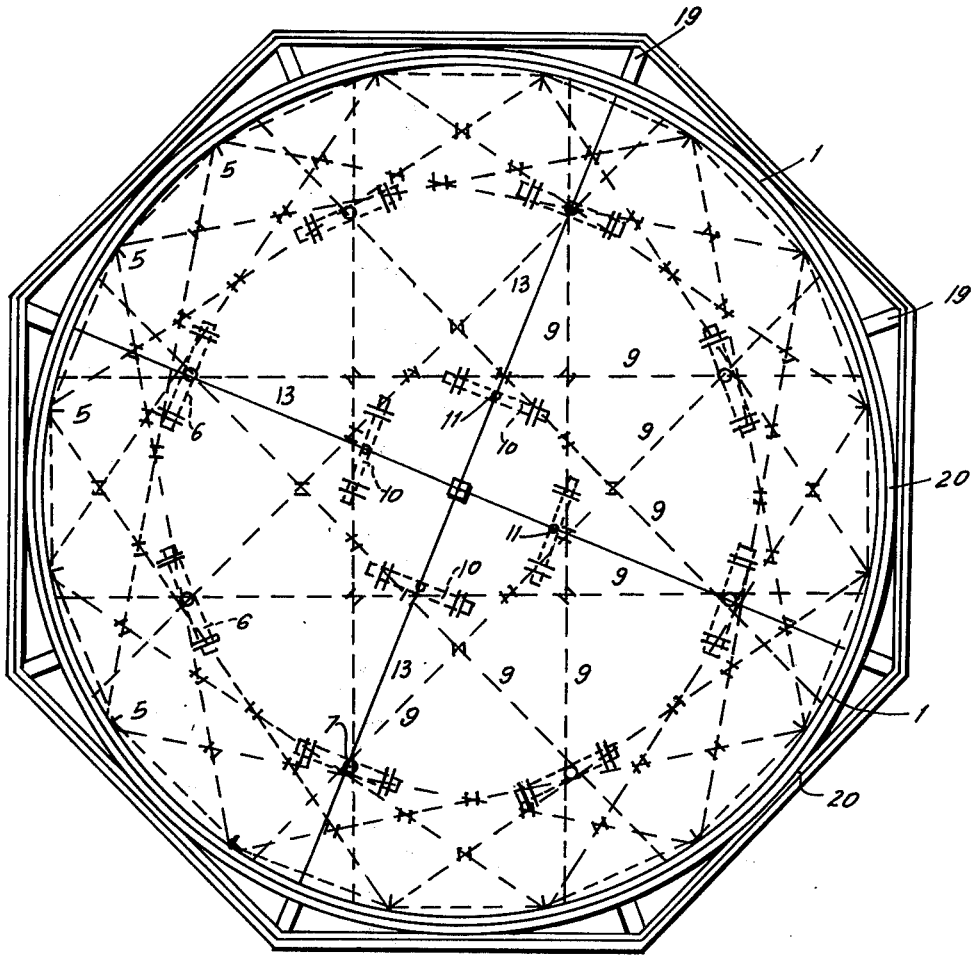
FIG. 4 is a view as in FIG. 3 showing a third cable net with the peak support.
Figure 5:
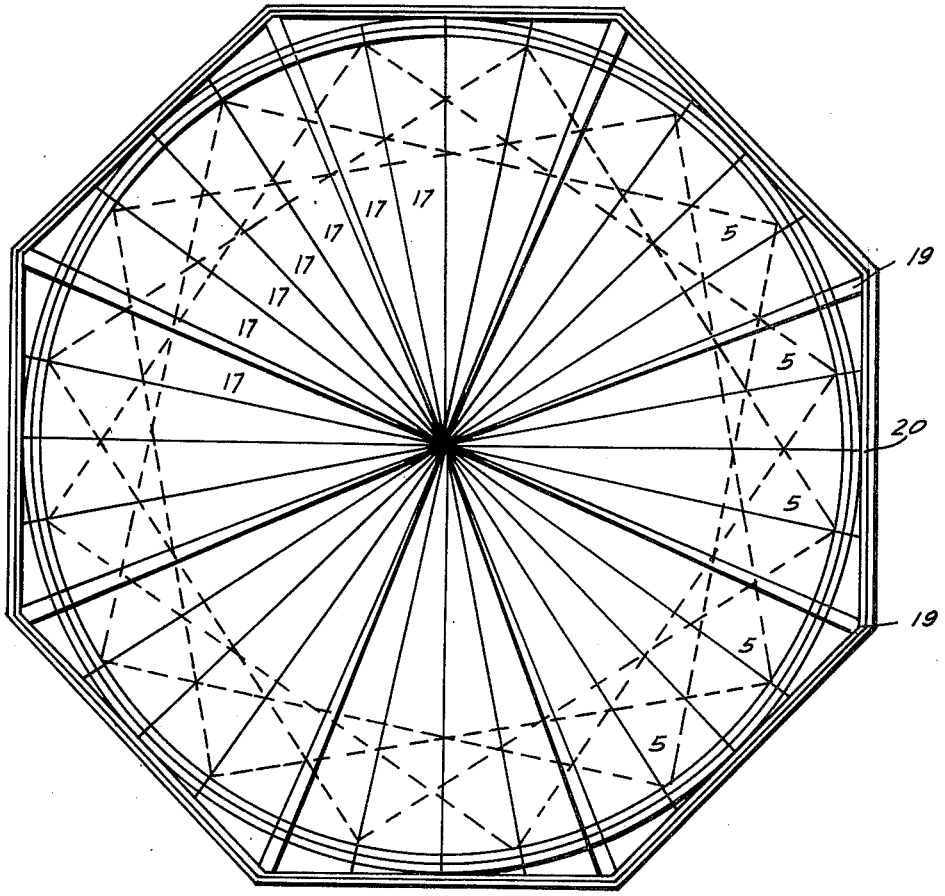
FIG. 5 is a top view of the structure with radially diposed cables connecting the upper end of the peak support to the supporting ring.
Figure 6:
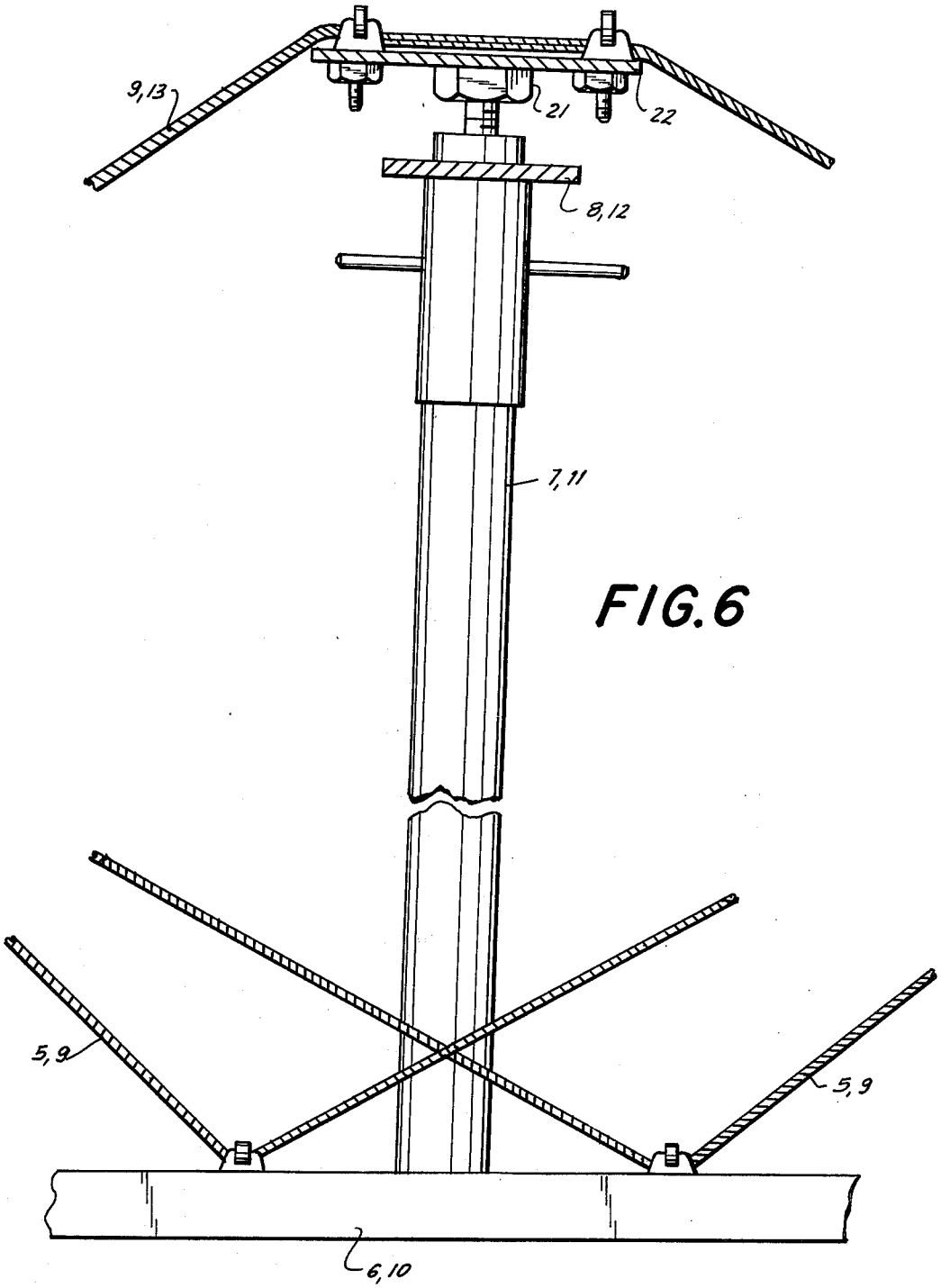
FIG. 6 is an illustration of a vertical support.
Figure 7:
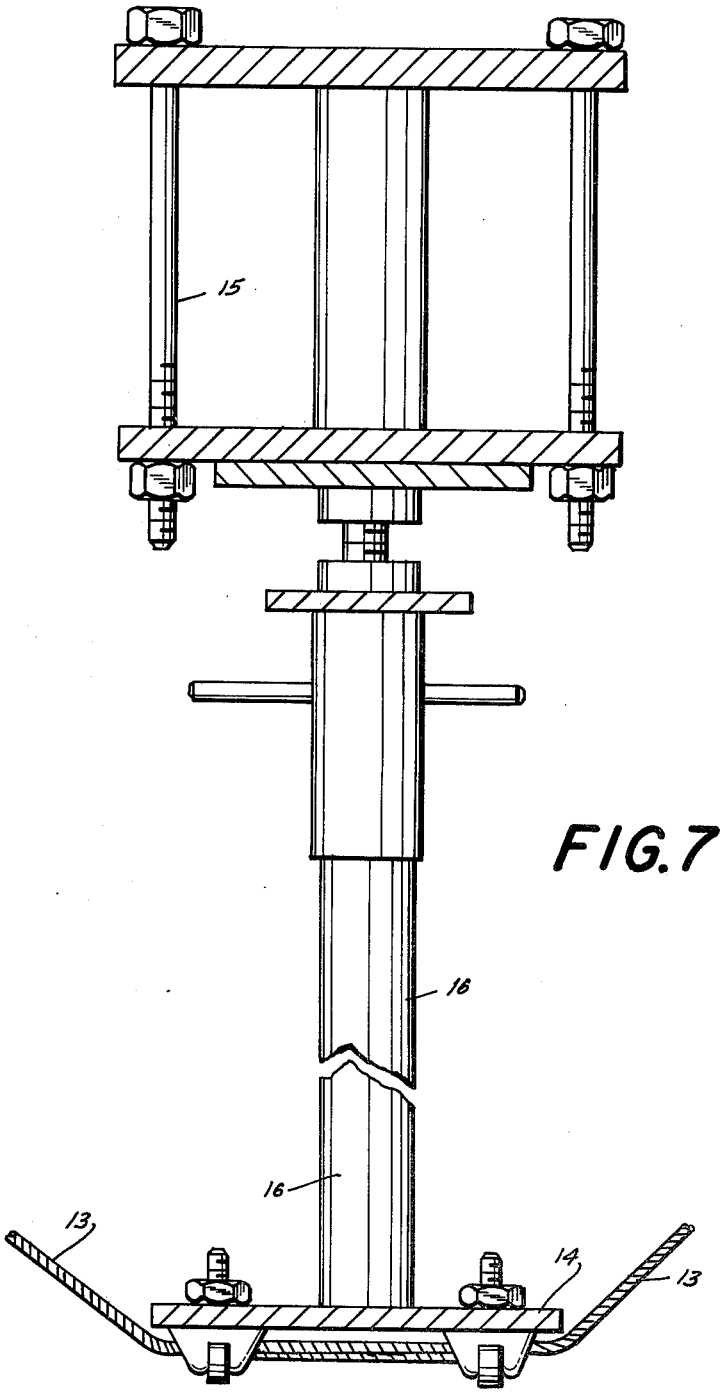
FIG. 7 is an illustration of the peak support.
Figure 8B:
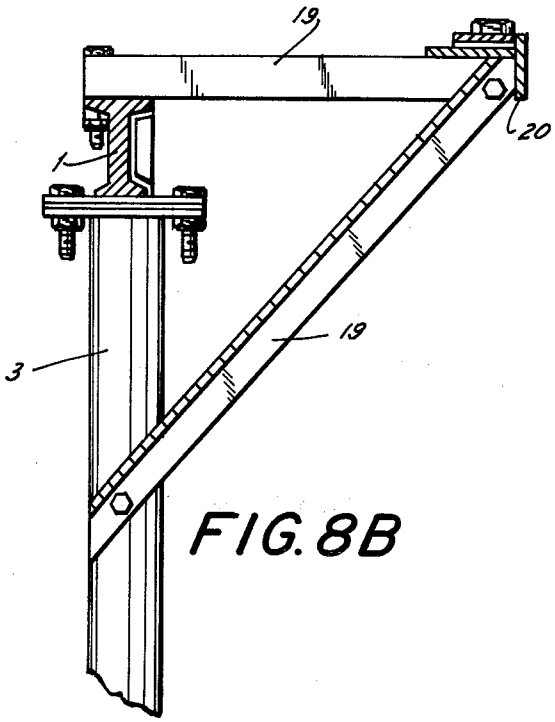
FIG. 8 is an illustration and a cross-sectional view of the stiff ring and its connection to the columns.
Figure 8A:
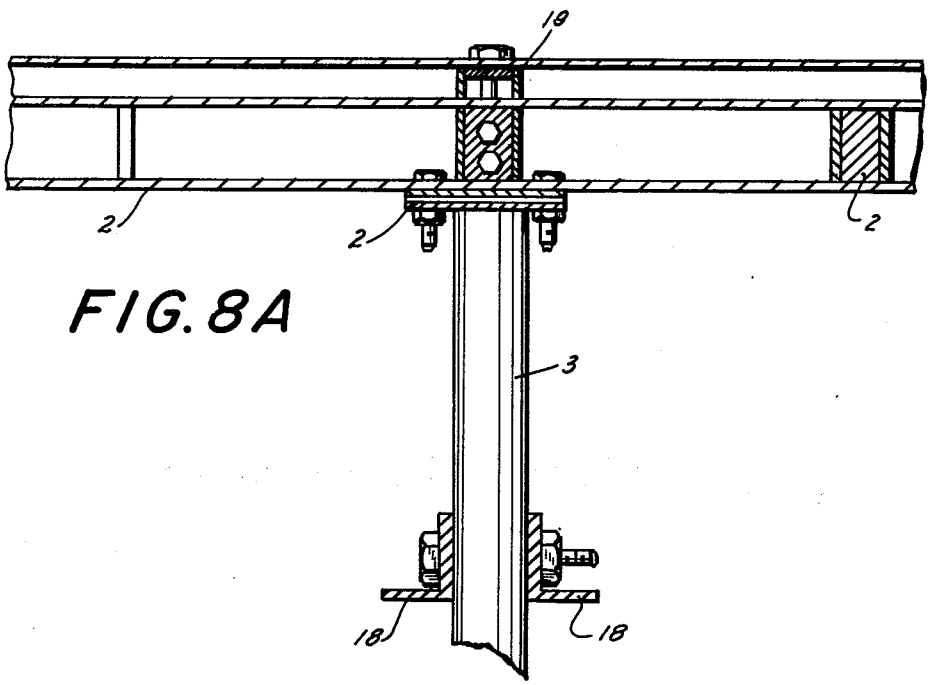
Figure 8C:
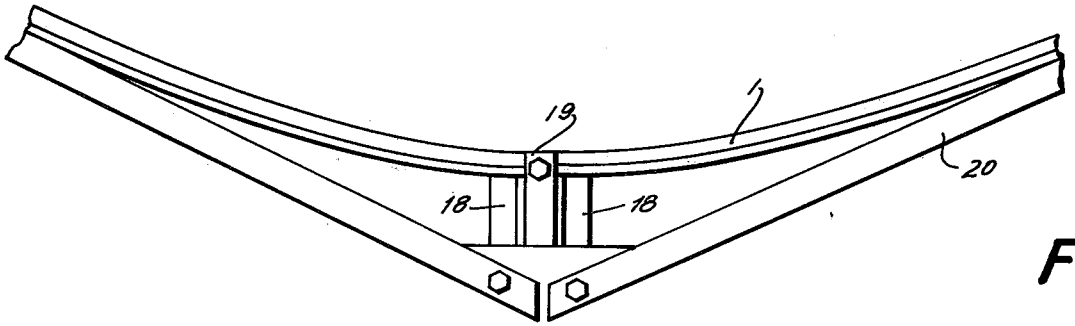

The structure of the invention comprises a supporting ring 1, stiffened by ribs 2, and an octagonal ring 20. A first cable net is formed by cables 5 which are stretched as chords of the supporting ring 1. Beams 6 are suspended from the centers of each two adjacent chords 5 and carry vertical supports 7. A second cable net is formed by cables 9, passing through the peaks of supports 7 and fastened rigidly to the supporting ring 1. Beams 10 are suspended from the centers of the adjacent cables 9 and carry vertical supports 11. A third cable net is formed by two perpendicular, diametrically disposed cables 13 fastened rigidly to the supporting ring 1 and passing through the peaks of the radially arranged vertical supports 7 and 11. At the crossing point of cables 13 there is disposed the peak support 14 and cables connect the upper end of the vertical support 14 to the supporting ring 1.

The erection of the structure is carried out in the following sequence: the supporting ring 1 is made up of a given number of sectors: and by means of an instrument (a theodolite) there are marked on its inner side at equal distances all points where the cables of the nets are to be connected to the supporting ring 1. Stiffening by ribs 2 is effected at these points and the holes, through which the anchoring devices pass, are drilled. This supporting ring 1 is then lifted to a height above the ground determined with respect to the predetermined deflection of the first cable net, and is supported on columns 3. Then the cantilevers 19 are mounted, and to them is suspended the additional stiffening ring 20, and its connection to the supporting ring 1 and to columns 3 is effected by means of braces 18.

The first cable net is made by stretching cables 5 as chords to the supporting ring 1 and these cables are fastened rigidly to it by means of anchoring devices (clamps). The centers of two adjacent chords 5 are connected by means of beams 6. To the bottoms of beams 6 there are suspended single loads of determined size for producing a prestressing of the cables, the first cable net receiving thus an exactly determined deflection. In this position the cables 5 are fastened rigidly in-between at their crossing by means of the same clamps. Onto beams 6, in their centers, there are positioned vertical supports 7 to the upper end of which there is mounted a prestressing device. The latter comprises a strip 8, 12 with nut and bolt 21, to the head of which there is fastened rigidly another strip 22 needed to effect the connection between the upper end of the vertical supports 7 and the cables 9 of a second cable net. The cables 9 pass two by two, crossing at 180° through the peaks of supports 7 and are fastened rigidly to them and the supporting ring 1 by means of clamps 1. The centers of the adjacent cables 9 are connected by means of beams 10; there are suspended on the bottoms of beams 10 the stressing single loads. Cables 9 are fastened rigidly in their points of intersection and the vertical supports 11 are positioned. To the upper ends of support 11 there are mounted stressing devices.

The last cable net is made up by passing through the peaks of the radially arranged supports 7 and 11 the cables 13, which are anchored to the supporting ring 1. In the point of intersection of cables 13 there is provided a strip 14 and onto it — the peak support 16, the upper end of which is connected to the supporting ring 1 by means of cables 17. To the bottom of strip 14 there is suspended a single stressing load.

The additional stressing of the cables is effected by means of the stressing devices, and then the single loads are removed from beams 6, 10 and strip 14.

The thus realized prestressed hanging cable structure is lifted to the desired level by means of hoisting mechanisms, arranged on the basic carrying columns 4 of the building.

What we claim is:

1. A hanging prestressed roof structure comprising a support ring spaced above the ground, a plurality of first cables forming a first cable net and spanning said ring along chords thereof said first cables having points of intersection spaced around the center of said ring, first posts secured at their bottoms to said first cables, a plurality of second cables spanning said ring along chords thereof forming a second cable net, said second cables being secured to the tops of said first posts, a plurality of second posts secured at their bottoms to said second cables, and an upright peak support connected at its top directly to said ring by further cables while being supported at its bottom from additional cables secured to the tops of at least some of said posts.

2. The roof structure defined in claim 1 wherein the cables of said second cable net lie at right angles to one another.

3. The roof structure defined in claim 1 wherein at each intersection point of two cables of the same net the cables are connected rigidly together.

4. The roof structure defined in claim 1 wherein each of said posts is provided with a beam at its lower end affixed to the cables of the respective cable net.

* * * * *

UNITED STATES PATENT AND TRADEMARK OFFICE

CERTIFICATE OF CORRECTION

PATENT NO. : 4,130,969

DATED : 26 December 1978

INVENTOR(S) : IVAN B. IVANOV

It is certified that error appears in the above-identified patent and that said Letters Patent are hereby corrected as shown below:

In the heading, left-hand column, line 30, under "Foreign Application Priority Data" read correctly as follows:

-- Dec. 11, 1975 Bulgaria .....31755--

Signed and Sealed this

*Third* Day of *April 1979*

[SEAL]

*Attest:*

RUTH C. MASON
*Attesting Officer*

DONALD W. BANNER
*Commissioner of Patents and Trademarks*